United States Patent [19]

Christiansen

[11] Patent Number: 4,592,299

[45] Date of Patent: Jun. 3, 1986

[54] SHIP'S-VESSEL'S RUDDER WITH REDUCED DRAG EFFECTED FACTORS

[76] Inventor: Joseph R. Christiansen, 1214 Harrisway, Galveston, Tex. 77550

[21] Appl. No.: 670,216

[22] Filed: Nov. 7, 1984

[51] Int. Cl.[4] ..... B63H 25/38

[52] U.S. Cl. ..... 114/162; 114/57; 440/51

[58] Field of Search ..... 114/274, 57, 126, 127, 114/128, 140, 149, 152, 162, 163, 164; 440/51; 441/79

[56] References Cited

U.S. PATENT DOCUMENTS

| | | | |
|---|---|---|---|
| 45,959 | 1/1865 | Crosby | 114/162 |
| 3,508,511 | 4/1970 | Bosnick | 114/126 |
| 3,570,438 | 3/1971 | Mackowiak | 114/126 |
| 3,670,685 | 6/1972 | Milessa | 114/162 |
| 3,847,104 | 11/1974 | Kaufer | 114/162 |

FOREIGN PATENT DOCUMENTS

| | | | |
|---|---|---|---|
| 446921 | 5/1936 | United Kingdom | 114/162 |
| 2072599 | 10/1981 | United Kingdom | 114/162 |

*Primary Examiner*—Trygve M. Blix
*Assistant Examiner*—Thomas J. Brahan
*Attorney, Agent, or Firm*—Harvey B. Jacobson

[57] ABSTRACT

An upstanding panel-like body is provided including top, bottom and front and rear margins and opposite side surfaces extending between those margins. The opposite side surfaces are generally vertically straight and parallel. The front and rear margins are transversely elliptically rounded and the opposite sides of the convexly rounded front margin merge rearwardly into first generally constant radius of curvature laterally outwardly convex forward opposite side partial cylindrical surfaces which in turn merge rearwardly into second generally constant radius of curvature and laterally outwardly concave mid-length opposite side surfaces merging rearwardly into third generally constant radius of curvature laterally outwardly convex rear opposite side partial cylindrical surfaces joined at their rear portions by the convexly rounded rear margin of the body.

13 Claims, 4 Drawing Figures

SHIP'S-VESSEL'S RUDDER WITH REDUCED DRAG EFFECTED FACTORS

BACKGROUND OF THE INVENTION

1. Field of the Invention

The present invention relates to ships and more specifically to ship's rudders. The rudder of the instant invention is specifically shaped and contoured along its front to rear extending oppposite side surfaces in a manner to reduce propeller turbulence and thrust losses as a result of such turbulence. The opposite side surface contours of the rudder are such to release the high pressures and drag factors to the stern of the associated vessel ususally associated with propeller turbulence.

2. Description of Related Art

Various different forms of differently shaped and contoured rudders heretofore have been designed such as those disclosed in U.S. Pat. Nos. 45,959, 588,512, 1,844,303, 2,139,163, 2,363,335, 2,431,449, 2,640,453, and 2,800,150. However, these previously known forms of propellers do not provide the laminar flow and propeller turbulence reducing factors of the rudder of the instant invention.

SUMMARY OF THE INVENTION

The rudder of the instant invention is generally rectangular in plan and includes fore and aft marginal edges as well as top and bottom marginal edges. The opposite side surfaces of the rudder are substantially vertically straight, but are contoured in front-to-rear direction. The forward and aft marginal edges of the rudder are elliptically rounded and the rounded forward marginal edge merges rearwardly into first generally constant radius of curvature laterally outwardly convex forward opposite side partial cylindrical surfaces. The forward opposite side surfaces each in turn merge rearwardly into second generally constant radius of curvature laterally outwardly concave mid-length opposite side surfaces and the latter surfaces merge rearwardly into third generally constant radius of curvature laterally outwardly convex rear opposite side partial cylindrical surfaces joined at their rear portions by the rounded rear marginal edge of the rudder. The radii of curvature of the forward and mid-length convex and concave partial cylindrical surfaces are generally equal and the radii of curvature of the rear opposite side partial cylindrical surfaces are approximately two-thirds the radii of curvature of the forward and mid-length opposite side surfaces. In addition, the maximum transverse width of the rudder between the forward partial cylindrical surfaces is generally three times the minimum transverse width of the rudder between the mid-length partial cylindrical surfaces and generally one and one-half times the maximum transverse width of the rudder between the rear partial cylindrical surfaces.

The main object of this invention is to provide an improved ship's rudder for disposition behind a screw-type propeller provided on the associated ship and with the rudder constructed in a manner to substantially reduce water turbulence and rudder vibration.

Another object of this invention is to provide a rudder for disposition behind a ship's screw-type propeller and including a configuration which will assist in maintaining maximum laminar flow of water rearward along the rudder.

Yet another object of this invention is to provide a rudder construction effective to reduce water turbulence caused by the screw propeller forward of the rudder and thereby provide less resistance to rearward flow of water past the propeller and result in greater effective thrust being developed by the propeller.

Another important object of this invention is to provide a laminar flow rudder capable of appreciably increasing the operational characteristics of the associated ship or vessel.

A final object of this invention is to provide an improved form of laminar flow rudder which will conform to conventional forms of manufacture be of simple construction and dependable in operation so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
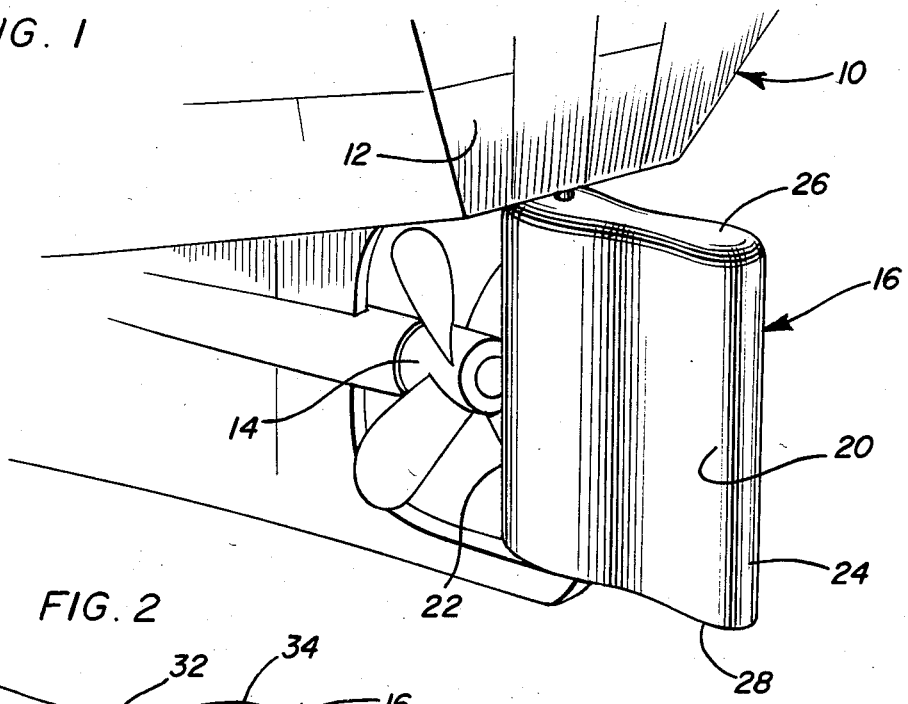
FIG. 1 is a perspective view of the rear portion of a ship illustrating the rudder of the instant invention mounted for oscillation about a vertical axis closely behind a screw-type marine propeller of the ship.

Referring now more specifically to the drawings the numeral 10 generally designates the hull of a ship including a stern 12 beneath which an engine driven marine propeller 14 is journaled.

The rudder of the instant invention is referred to in general by the reference numeral 16 and is mounted closely rearward of the propeller 14 from a vertical rudder post 18 for oscillation about the center axis of the post 18.

The rudder 16 comprises a panel-like body 20 including substantially vertical fore-and-aft marginal edges 22 and 24 as well as upper and lower marginal edges 26 and 28. The body 20 is substantially rectangular in side elevation and of somewhat greater height than front-to-rear length. However the height and length ratio of the side elevation of the body 20 may vary as desired according to the particular marine installation in which the rudder 16 is to be used.

Figure 2:
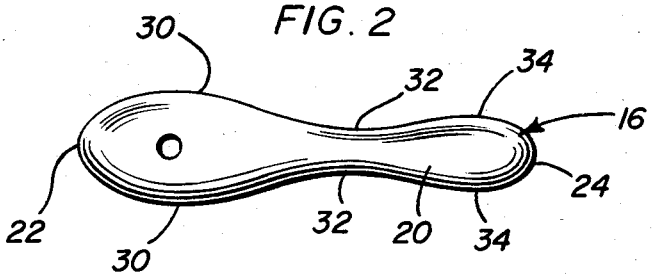
FIG. 2 is an enlarged top plan view of the rudder.
Figure 3:
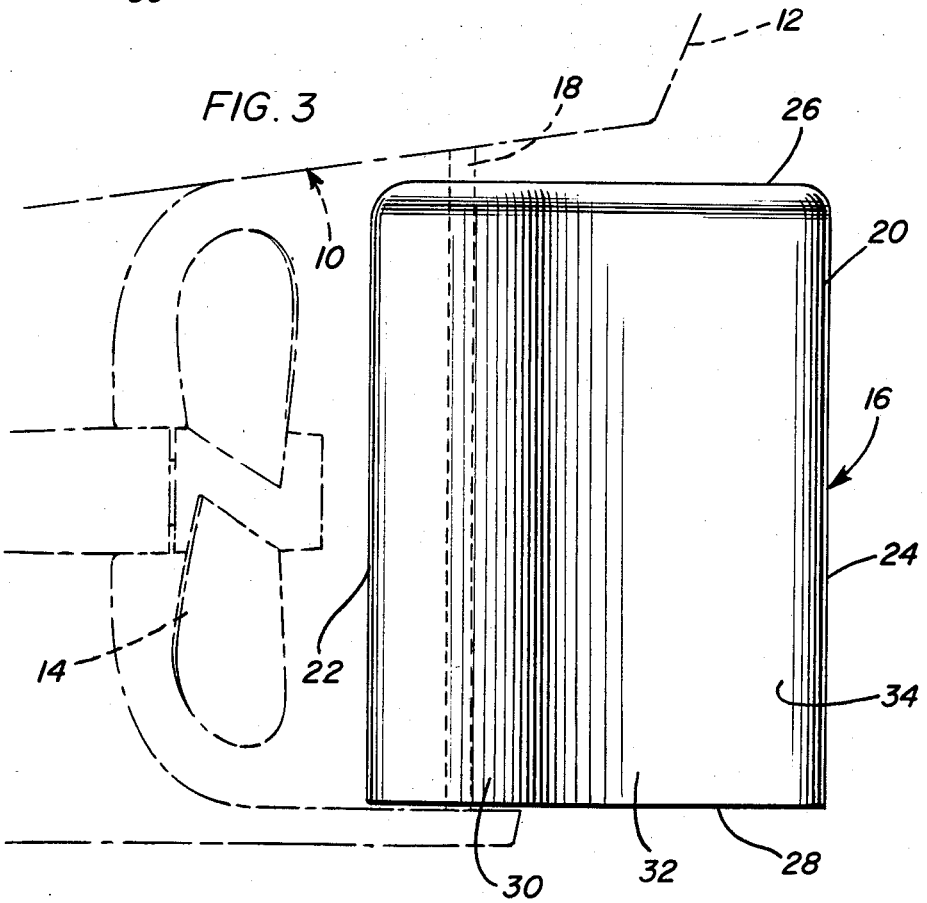
FIG. 3 is an enlarged side elevational view of the rudder.

With reference now more specifically to FIG. 2 of the drawings it may be seen that the fore marginal edge 22 as well as the aft marginal edge 24 are convexly elliptically rounded. The opposite sides of the fore marginal edge 22 merge rearwardly into first generally constant radius of curvature laterally outwardly convex forward opposite side partial cylindrical surfaces 30 and the surfaces 30 in turn merge rearwardly into second generally constant radius of curvature laterally outwardly concave mid-length opposite side surface 32. The mid-length opposite side surfaces 32 merge rearwardly into third generally constant radius of curvature laterally outwardly convex rear opposite side partial cylindrical surfaces 34 and the rear ends of the surfaces 34 merge smoothly into the opposite side surfaces of the elliptically convexly rounded aft marginal edge 24.

It is further pointed out that the maximum width of the rudder 16 or body 20 between the surfaces 30 is generally equal to three times the minimum transverse width of the body 18 between the surfaces 32 and generally one and one-half times the maximum transverse width of the body 20 between the surfaces 34. Accordingly, if the minimum rudder width between the surfaces 32 is X, the maximum rudder width between the surfaces 30 is 3X and the maximum rudder width between the surfaces 34 is 2X.

It is further pointed out that the radii of curvature of the surfaces 30 and 32 is generally one-half and fore-and-aft length of the body 20 and that the radii of curvature of the surfaces 34 is generally two-thirds the radii of curvature of the surfaces 30 and 32.

With the above referred to relative dimensions and contours the body 20 is of a horizontal cross-sectional shape generally similar to the elevational shape of a tenpin having an elliptically rounded base end. The contour of the body 20 is such that the most turbulent water directed rearward from the propeller is first divided and gradually expanded, thereafter subject to inward deflection by Coanda effect and then again outwardly deflected before being finally inwardly deflected about the rounded aft marginal edge 24 of the body 20 by Coanda effect.

Although the specific reasons why the particular horizontal cross-sectional shape of the body 20 operates efficiently to reduce turbulence and thus increase thrust and speed and to reduce vibration and otherwise increase performance of the ship 10 are not clearly apparent, a conventional rudder on a 150 foot offshore supply boat was converted to have the configuration of the rudder 16 and the offshore supply boat was tested for improvements in operating characteristics. At the time of the test the sea of the Gulf of Mexico was three to five feet and maneuverability of the ship was increased to the extent that the turning radius to both port and starboard was reduced by 20% with noticeably less vibration. At this point it is pointed out that the vibration was deemed to be reduced up to 60% and the ship, at designed speeds, consumed up to approximately 30% less fuel as a result of the increase in effective thrust by the propellers of the ship due to the reduction of turbulence and more efficient laminar flow of water over the opposite side surfaces of the body 20 of the rudder 16. Of course, an increase in designed speeds was also noted. Further, for additional reasons which are not yet clear the test ship appeared to generate not only less turbulence at the stern but also less bow wave. This of course may contribute considerably to the increased speed performance of the test ship.

Figure 4:
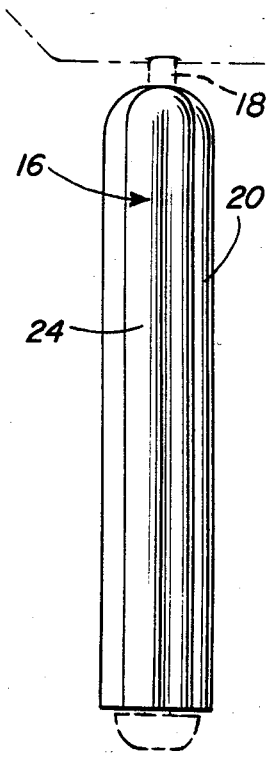
FIG. 4 is an enlarged rear elevational view of the rudder.

From FIG. 4 of the drawings it may be seen that the lower marginal edge 28 of the body 20 is substantially horizontal and that the upper marginal edge 26 of the body 20 is rounded so as to be substantially semi-cylindrical in vertical transverse cross section at all points disposed between the elliptically rounded fore-and-aft marginal edges 22 and 24.

Of course, it may be readily appreciated how a conventional rudder may be modified in accordance with the present invention, even without removing the conventional rudder and that new rudders may be readily manufactured in accordance with the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A laminar flow ship's rudder for disposition closely behind and in horizontal registry with the ship's propeller, said rudder including an upstanding panel-like body including top, bottom and front-and-rear margins and opposite side surfaces extending between said margins, said opposite side surfaces being generally vertically straight and parallel, said front-and-rear margins each being transversely convexly rounded, the opposite side portions of said front margin smoothly merging rearwardly into first generally constant radius of curvature laterally outwardly convex forward opposite side partial cylindrical surfaces which in turn smoothly merge rearwardly into second generally constant radius of curvature laterally outwardly concave mid-length opposite side surfaces smoothly merging rearwardly into third generally constant radius of curvature laterally outwardly concave mid-length opposite side surfaces smoothly merging rearwardly into third generally constant radius of curvature laterally outwardly convex rear opposite side partial cylindrical surfaces which in turn smoothly merge rearwardly into the opposite side portions of said rounded rear margin of said body.

2. The rudder of claim 1 wherein the radii of curvature of said third surfaces is generally equal to two-thirds the radii of curvature of said first and second surfaces.

3. A laminar flow ship's rudder for disposition closely behind and in horizontal registry with a ship's propeller, said rudder including an upstanding panel-like body including top, bottom and front-and-rear margins each being transversely convexly rounded, the opposite side portions of said front margin smoothly merging rearwardly into first generally constant radius of curvature laterally outwardly convex forward opposite side partial cylindrical surfaces which in turn smoothly merge rearwardly into second generally constant radius of curvature laterally outwardly concave mid-length opposite side surfaces smoothly merging rearwardly into third generally constant radius of curvature laterally outwardly convex rear opposite side partial cylindrical surfaces which in turn smoothly merge rearwardly into the opposite side portions of said rounded rear margin of said body, the maximum transverse width of said rudder between said forward opposite side surfaces being generally three times the minimum transverse width of said rudder between said mid-length opposite side surfaces and generally one and one-half times the maximum transverse width of said rubber between said rear opposite side surfaces.

4. The rudder of claim 3 wherein said front and rear margins are elliptically rounded.

5. The rudder of claim 4 wherein the radii of curvature of said first and second surfaces are generally equal.

6. The rudder of claim 5 wherein the radii of curvature of said third surfaces is generally equal to two-thirds the radii of curvature of said first and second surfaces.

7. The rudder of claim 6 wherein said upper margin is transversely convexly rounded.

8. The rudder of claim 7 wherein said rudder is of a front-to-rear length of generally three times said maximum rudder width between said forward partial cylindrical surfaces.

9. A laminar flow ship's rudder for disposition closely behind and in horizontal registry with a ship's propeller, said rudder including an upstanding panel-like body including top, bottom and front-and-rear margins and opposite side surfaces extending between said margins, said opposite side surfaces being generally vertically straight and parallel, said front-and-rear margins each being transversely convexly rounded, the opposite side portions of said front margin smoothly merging rearwardly into first laterally outwardly convex forward opposite side surfaces which in turn smoothly merge rearwardly into second laterally outwardly concave mid-length opposite side surfaces smoothly merging rearwardly into third laterally outwardly convex rear opposite side surface which in turn smoothly merge rearwardly into the opposite side poritions of said rounded rear margin of said body.

10. The rudder of claim 9 wherein said body includes means centrally intermediate the maximum transverse width area of said rudder forward surfaces for mounting said body for adjustable angular displacement about a vertical axis.

11. The rudder of claim 9 wherein the maximum transverse width of said rudder between said forward opposite side surfaces is generally three times the minimum transverse width of said rudder between said mid-length opposite side surfaces and generally one and one-half times the maximum transverse width of said rudder between said rear opposite side surfaces.

12. The rudder of claim 11 wherein the radii of curvature of said third surfaces is generally equal to two-thirds the radii of curvature of said first and second surfaces.

13. The rudder of claim 12 wherein said rudder is of a front-to-rear length of generally three times said maximum rudder width between said forward partial cylindrical surfaces.

* * * * *